US005676218A

United States Patent [19]

Hirose

[11] Patent Number: 5,676,218

[45] Date of Patent: Oct. 14, 1997

[54] ROLLER SKATES AND THRUSTING MEANS USED IN THE SAME

[76] Inventor: Tokuzo Hirose, 13-13, Higashiyama-cho, Ashiya-shi, Hyogo, Japan

[21] Appl. No.: 565,865

[22] Filed: Dec. 1, 1995

[30] Foreign Application Priority Data

Jul. 4, 1995 [JP] Japan ..... 7-169022

[51] Int. Cl.[6] ..... A63C 17/12

[52] U.S. Cl. ..... 180/181; 280/11.27

[58] Field of Search ..... 280/11.26, 11.27, 280/11.28, 618, 87.042; 180/181, 180; 248/133

[56] References Cited

U.S. PATENT DOCUMENTS

| | | | |
|---|---|---|---|
| 892,164 | 6/1908 | King | 280/11.28 |
| 2,454,321 | 11/1948 | Howard | 280/11.27 |
| 2,857,008 | 10/1958 | Pirrello | 180/181 |
| 4,546,841 | 10/1985 | Sipiano | 180/181 |
| 5,330,026 | 7/1994 | Hsu et al. | 180/181 |

OTHER PUBLICATIONS

Scooting with 40–mph Skates; Life Magazine; p. 83; author unknown Jan. 21, 1957.

*Primary Examiner*—Brian L. Johnson
*Assistant Examiner*—Avraham Lerner
*Attorney, Agent, or Firm*—Brian M. Dingman

[57] ABSTRACT

A pair of roller skates capable of skating while keeping the soles in nearly horizontal state even on a slope is presented. A base of a roller skate is provided with driving wheels driven by an internal-combustion engine, and driven wheels. On a sole plate, the foot is placed detachably, and a tilting mechanism is provided between the sole plate and the base. Ends of a first link and a second link are coupled to the front part of the sole plate and the base, respectively, while other ends are coupled to a first nut. Ends of a third link and a fourth link are coupled to the rear part of the sole plate and the base, respectively, while other ends are coupled to a second nut. A screw rod is inserted in the first and second nuts, and a link drive is provided in the middle of the screw rod. The link drive is coupled to the base, and rotates the screw rod about the axial line.

8 Claims, 11 Drawing Sheets

1
9
7
8
2a
32
M1
2
M2
2b
38
39
31
III
30a
L2
L4
37a
III
30
26
47
37
30b
41
42
37b
4
43
27b
33
40
34b
34
A
27
48
44a
49
25
27a
L1
44
L3
34a
28
45
35
29
36
3a
46
44b
3
3b
11
18
14
13
10
71

ROLLER SKATES AND THRUSTING MEANS USED IN THE SAME

BACKGROUND OF THE INVENTION

1. Field of the Invention

The present invention relates to a pair of roller skates.

2. Description of the Related Art

Conventional commercial roller skates are used in pairs. The pair of roller skates are not provided with driving means for driving wheels, and the skater moves the skates forward by the force of moving the legs back and forth or kicking behind.

The conventional roller skate is provided with brake means as stopping means, and the roller skate is braked by the frictional force between the brake member and the road surface.

When climbing up a slope, the toe is raised relative to the heel in order to keep the body nearly vertical to the horizontal plane. When skating down a slope, contrary to the case of climbing up, the toe is lowered relative to the heel.

In such prior art, driving and braking of the roller skate must depend on the skater, and there are problems in comfort while skating.

When climbing up a slope, one must skate while keeping the toe always raised relative to the heel, and an undesired burden is applied to the foot. When going down a slope, the toe must be always lowered relative to the heel, and as a consequence, when stopped, for example, a particular burden is applied to the toe.

SUMMARY OF THE INVENTION

It is hence an object of the invention to present a pair of roller skates capable of keeping the feet in nearly horizontal state, when going up or down a steep slope, by incorporating driving means in at least one of plural wheels provided in one of the pair of roller skates.

The invention provides a pair of roller skates each comprising plural wheels, wherein driving means is provided to drive at least one of plural wheels of one of the pair of roller skates.

According to the invention, the driving means is provided in at least one of the plural wheels provided on a base, and it is possible to skate, for example, without moving the foot back and forth, or kicking the road surface.

The pair of roller skates of the invention is characterized in that operating means for manipulating by one hand to activate and inactivate the driving means.

Also according to the invention, since the driving means is activated and inactivated by the operating means that can be manipulated by one hand, both hands are not occupied, and as well the operation by one hand does not disturb keeping the balance by the both hands.

The invention is characterized in that brake means is provided at the heel side of one of the pair of roller skates.

According to the invention, the brake means can be actuated by landing the heel of the roller skate on the road surface. Therefore, braking of the roller skate can be controlled by one foot of the skater.

The pair of roller skates of the invention is characterized in that the drive means can be controlled by radio.

Therefore, the hand for holding the operating means can be moved freely.

The pair of roller skates of the invention is characterized in that the pair of roller skates can be attached so that shoes might be put on and off.

Therefore, the pair of roller skates can be worn keeping shoes on.

Each of the pair of skates of the invention comprises a base provided with plural wheels, a sole plate on which a foot is detachably mounted, and tilting means for tilting the base back and forth relative to the sole plate, provided between the base and the sole plate.

Also according to the invention, for example, when climbing up a hill, by tilting the base backward relative to the sole plate, it is possible to skate while keeping horizontal the foot mounted on the sole plate, and therefore, when climbing up a hill, it is possible to skate while keeping the feet horizontal the same as when skating a horizontal plane, so that undesired loading against the feet may be avoided. When going down a hill, by tilting the base forward relative to the sole plate by the tilting means, it is possible to skate while keeping the foot mounted on the sole plate horizontal.

The invention also provides a pair of roller skates each comprising plural wheels, a base provided with plural wheels, a sole plate on which a foot is detachably mounted, and tilting means for tilting the base back and forth relative to the sole plate, provided between the base and the sole plate.

Therefore, for example, when climbing up a hill, by tilting the base backward relative to the sole plate, it is possible to skate while keeping the foot mounted on the sole plate, and therefore horizontal, when climbing up a hill, it is possible to skate while keeping the feet horizontal the same as when skating a horizontal plane, so that undesired loading against the feet may be avoided. When going down a hill, by tilting the base forward relative to the sole plate by the tilting means, it is possible to skate while keeping the foot mounted on the sole plate horizontal.

The tilting means of the roller skate of the invention couples the toe sides of the base and the sole plate so as to be dislocated angularly, and the heel and toe sides are adjustable up and down. Therein the toe side serves as fulcrum.

According to the invention, the tilting means is provided so that it can be opened and closed under the function of the toe side as fulcrum, and hence when the heel side of the base and sole plate climbing up a hill, by opening the heel side by the tilting means to tilt the base backward of the sole plate, it is possible to skate up the hill while keeping the feet in nearly horizontal state.

Each of the pair of roller skates of the invention is characterized in that the tilting means is provided so that the heel and toe sides of the base are adjustable vertically.

Therefore, when climbing up a hill, by lowering the heel side of the base relative to the sole plate, that is, tilting backward, and adjusting up and down the height of the heel side of the base so that the sole plate may be horizontal, it is possible to skate up a hill while keeping the feet in nearly horizontal state. Or when descending a hill, by lowering the toe side of the base, that is, tilting forward, and adjusting up and down the toe side of the base to keep the sole plate nearly horizontal, it is possible to descend the hill while keeping the feet in nearly horizontal state.

The tilting means of the roller skate of the invention comprises a first link having one end coupled to the front part of the base by a first pin and extending backward, a second link having one end coupled to the front part of the sole plate by a second pin, extending backward, and having other end coupled to the other end of the first link by a third pin, a third link having one end coupled to the rear part of the base by a fourth pin and extending forward, a fourth link having one end coupled to the rear part of the sole plate by a fifth pin, a fourth link extending forward and having the rear end coupled to the other end of the third link by a sixth pin, a first nut fixed to the third pin, a second nut fixed to the sixth pin, a screw rod having both ends which are screwed into the first and second nuts and extending along the running direction, and a motor rotating and driving the screw rod around the axial line of the screw rod.

When the screw rod is rotated normally in the rotating direction for propelling the first nut from the front part to the rear part of the base, the second nut is also propelled from the front part to the rear part of the base. Therefore, by normally rotating the screw rod by the motor, when the first nut is propelled, the second link and first link coupled to the first nut by the third pin are dislocated angularly so that the ends of the first and second links may come closer to each other, and therefore the front part of the base and the front part of the sole plate coupled to the first and second links respectively by the first and second pins come closer to each other moreover, simultaneously with the propelling of the first nut by normal rotation of the screw rod, the second nut is also propelled, and the third and fourth links coupled to the sixth pin of the second nut are dislocated angularly so that the ends of the third and fourth links may be apart from each other around the sixth pin, and the rear part of the base and the rear part of the sole plate coupled to the third and fourth links by the fourth and fifth pins respectively depart from each other. Therefore, by normally rotating the screw rod to propel the first and second nuts, the front parts of the base and sole plate are brought closer to each other, and the rear parts of the base and sole plate set apart from each other, so that the base can be tilted backward of the sole plate.

Therefore, by normally rotating the screw rod by the motor, the base can be securely tilted backward of the sole plate. Besides, by reversely rotating the screw rod, the first nut and second nut are propelled from the rear part to the front part of the base, and by the reverse action of normal rotation of the screw rod, the base can be tilted forward of the sole plate.

In the pair of roller skates of the invention, plural wheels of each roller skate are arranged in line in the running direction.

Therefore, as compared with the roller skate having the wheels arranged in two rows in the running direction, since the wheels are arranged in line in the running direction, the running direction can be changed smoothly when turning.

The propulsive means of the invention is detachably provided in one of the pair of roller skates provided with plural wheels, and comprises one or plural wheels, and drive means for driving at least one of the one or plural wheels.

Therefore, by incorporating the propulsive means of the invention in a commercial roller skate, the skater can skate without, for example, moving the foot back and forth, or kicking the road surface.

Thus, according to the invention, in the pair of roller skates provided with plural wheels, the drive means and brake means for driving and braking at least one wheel of the plural wheels of one of the pair of roller skates can be easily controlled by the skater.

As a result, a pair of more comfortable roller skates can be presented. In particular, according to the invention, since the operating means can control the drive means by radio, the pair of roller skates can be used safely and operated easily, and an excellent effect is achieved.

Moreover, since the tilting means is provided in the roller skate, for example, when climbing up a hill, by tilting the base backward of the sole plate, it is possible to climb up the hill keeping the base nearly in horizontal state. When going down a slope, by tilting the base forward of the sole plate, it is possible to descend the slope while keeping the base in nearly horizontal state. Therefore, the same as when skating a horizontal plane, it is possible to ascend and descend a hill while keeping the feet nearly in horizontal state.

Besides, since plural wheels are arranged in a row in a running direction, the running direction can be changed smoothly.

Yet, since the propulsive means is detachably attached to the roller skate, for example, a commercial roller skate can be modified into a roller skate with a drive wheel.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
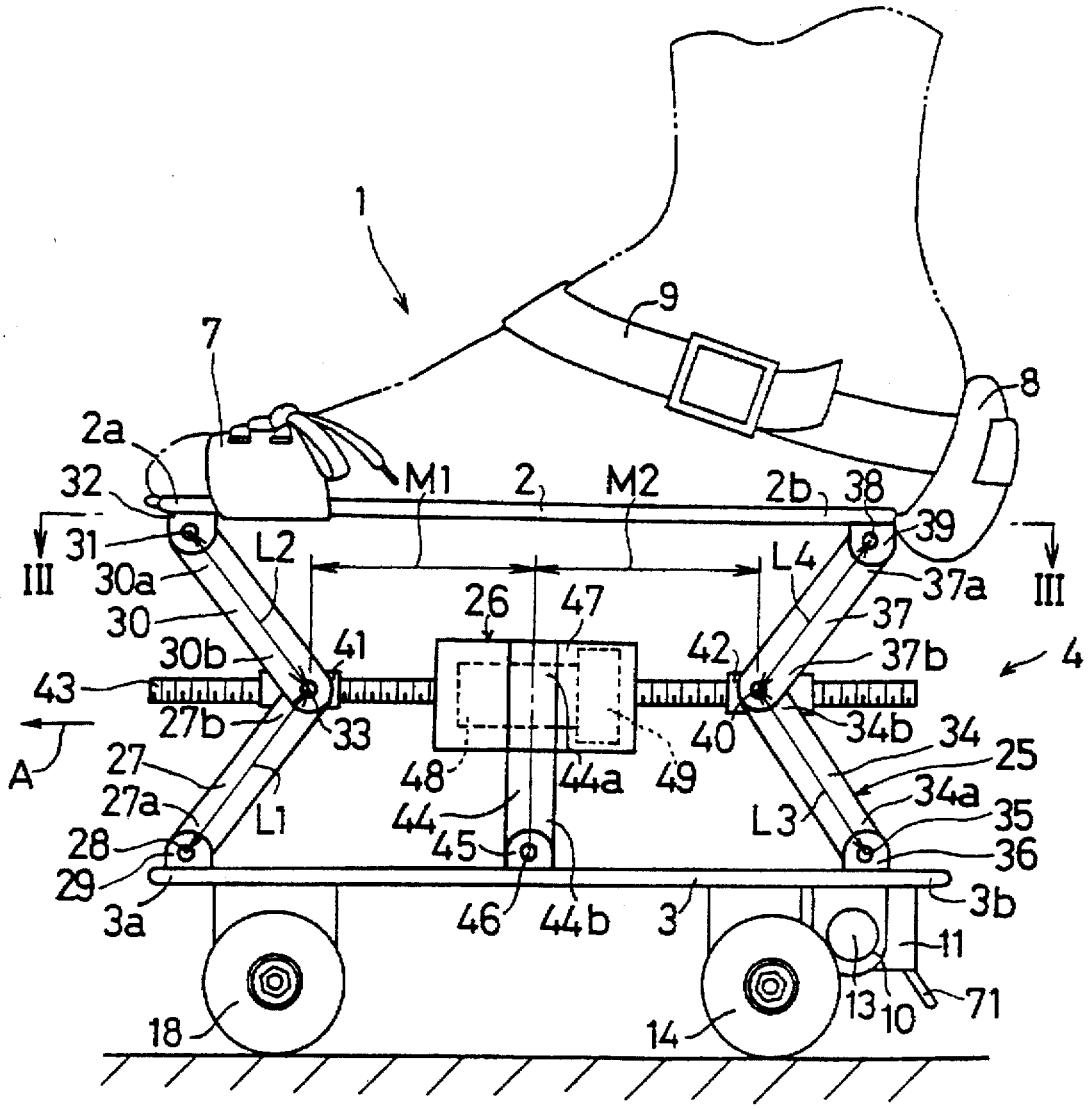
FIG. 1 is a side view of a roller skate 1 in an embodiment of the invention.

Now referring to the drawings, preferred embodiments of the invention are described below.

FIG. 1 is a side view showing the structure of one of a pair of roller skates in an embodiment of the invention. The roller skate 1 comprises a sole plate 2, a base 3, and tilting means 4. The sole plate 2 is provided with a front belt 7 and a heel protective member 8, among others. The heel protective member 8 has a rear belt 9, and the roller skate can be put on the foot by the front belt 7 and the rear belt 9. The base 3 has a driving wheel 14, a driven wheel 18 and others, thereby allowing to skate on a flat road surface in a forward direction A or a running direction. The tilting means 4 is interposed between the sole plate 2 and the base 3, and the base 3 can be tilted back and forth relative to the sole plate 2.

Figure 2:
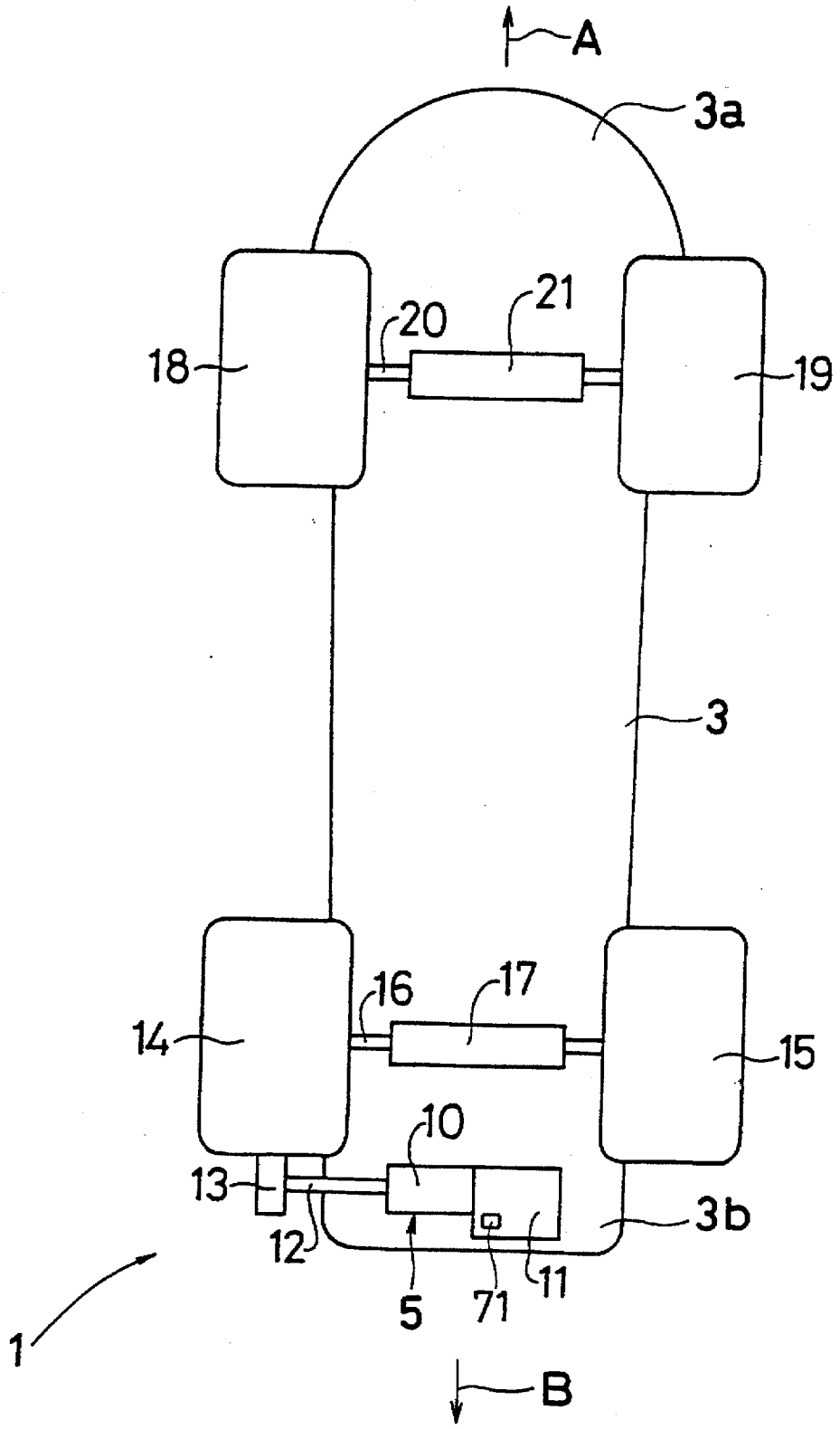
FIG. 2 is a simplified bottom view of the roller skate 1.

FIG. 2 is a simplified bottom view of the roller skate 1. At the heel side of the roller skate 1, that is, in the rear part 3b of the base 3 at a backward direction B side in the reverse direction to the forward direction A, running drive means 5 is provided. The running drive means 5 is composed of an internal-combustion engine 11, normal and reverse rotation transmitting means 10, a transmission shaft 12, and a transmission wheel 13, and the internal-combustion engine 11 rotates and drives the transmission shaft 12 through the normal and reverse rotation transmitting means 10. The peripheral edge of the transmission wheel 13 fixed on the transmission shaft 12 and the peripheral edge of the driving wheel 14 closely contact with each other, and the torque transmitted to the transmission wheel 13 is transmitted to the driving wheel 14 by frictional force.

The driving wheels 14, 15 are mounted on a rotary shaft 16 by means of nuts or the like, and are borne on the base 3 by a bearing 17. The torque transmitted from the transmission shaft 13 is transmitted to the driving wheel 14, and is also transmitted to the driving wheel 15 through the rotary shaft 16. The running drive means 5 is provided with an actuator 71, and by this actuator 71, the brake means provided in the normal and reverse rotation transmitting means 10 is turned on or off.

Figure 3:
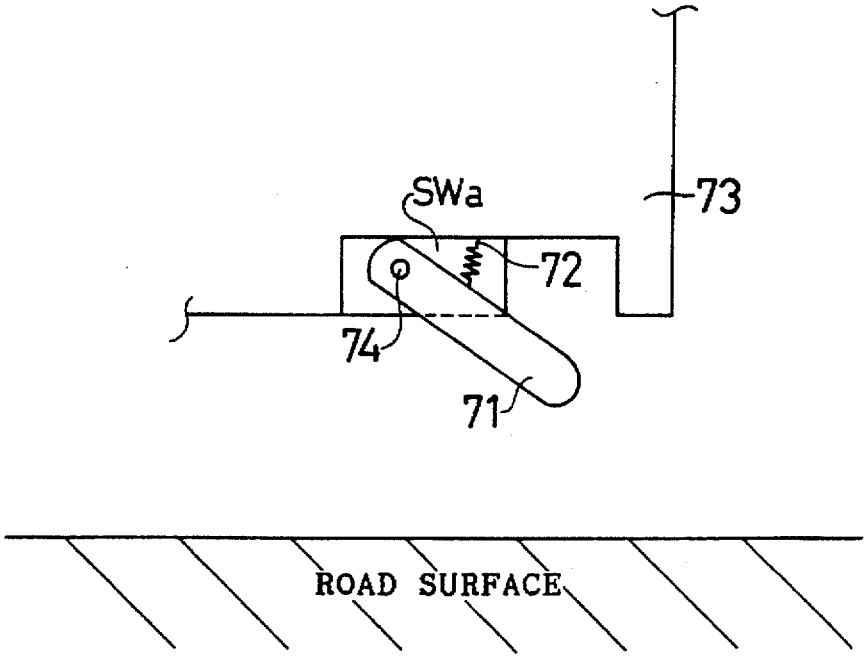
FIG. 3 is a side view of a control operation switch SWa.

FIG. 3 is a side view of a control operation switch SWa. The actuator 71 is installed in a brake operation switch SWa by a fulcrum 74. By the spring force of a spring 72 provided in the brake operation switch SWa, the actuator 71 is pressed down. A protective member 73 is composed of plastic or other synthetic resin, and protects the brake operation switch SWa.

By lowering the heel portion of the roller skate 1 above the road, the actuator 71 contacts with the road surface. At this time, resisting the spring force of the spring 72, the actuator 71 is dislocated angularly in the counterclockwise direction in FIG. 3, thereby turning on the brake operation switch SWa.

When the brake operation switch SWa is turned on, in the normal and reverse rotation transmitting means 10, it is changed over so that the transmission shaft 12 may rotate reversely. As a result, during skating by the roller skate 1 in the forward direction A, the drive wheel 14 is braked by the torque transmitted from the internal-combustion engine 11.

Coupled driving wheels 18, 19 provided at the toe side of the base 3, that is, in the front part 3a of the forward direction A side are mounted on a rotary shaft 20 by means of nuts or the like, and are borne on the base 3 through a bearing 21.

Figure 4:
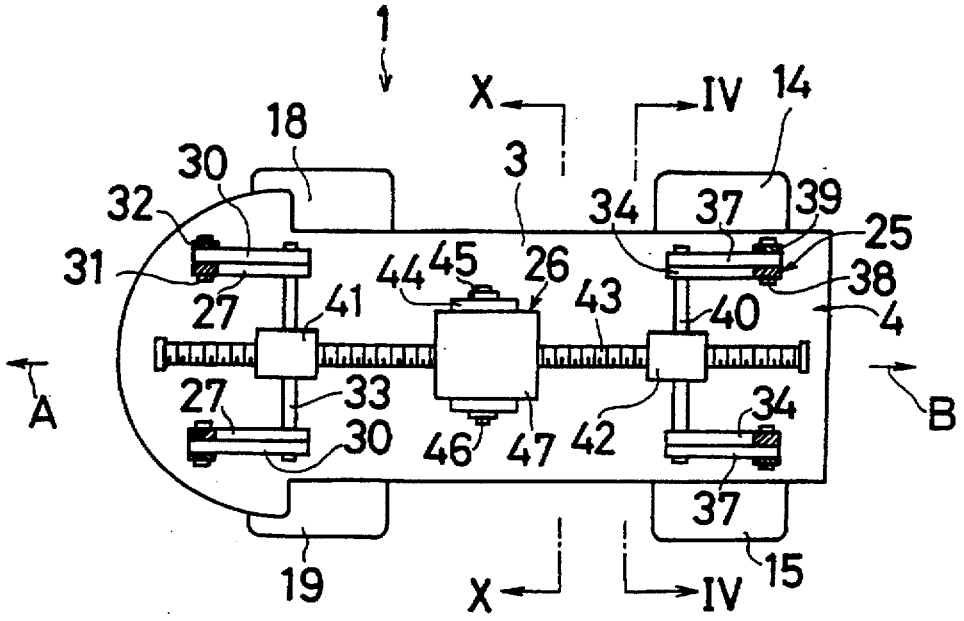
FIG. 4 is a simplified sectional view taken on cutting-plane line III—III in FIG. 1.

FIG. 4 is a simplified sectional view taken on cutting-plane line III—III of FIG. 1. The tilting means 4 is composed of a link mechanism 25 and link driving means 26. The link mechanism 25 has a symmetrical structure about a plane parallel to the forward direction A, running in the middle of the width direction of the base 3 as shown in FIG. 4. Accordingly the same reference numerals as those for the members of half of the symmetrical structure are given to the members of the other half and explanations are omitted.

Referring back to FIG. 1, the constitution of the link mechanism 25 is described. One end 27a of a first link 27 of the link mechanism 25 is coupled to the front part 3a of the base 3 by a first pin 28 through a mounting member 29. One end 30a of a second link 30 is provided so as to be dislocatable angularly by means of a second pin 31 through a mounting member 32 fixed to the front part 2a ahead in the forward direction A of the sole plate 2. Other ends 27b, 30b of the first and second links 27, 30 are coupled by a third pin 33 so as to be dislocatable angularly to each other. A third link 34 has its one end 34a attached to a mounting member 36 fixed to the rear part 3b of the base 3, so as to be dislocatable angularly by a fourth pin 35. One end 37a of a fourth link 37 is attached to a mounting member 39 fixed to the rear part 2b at the backward direction B side of the sole plate 2, so as to be dislocatable angularly by a fifth pin 38. The other ends 34b, 37b of the third and fourth links 34, 37 are coupled by a sixth pin 40 so as to be dislocatable angularly to each other. A first and second nuts 41, 42 are respectively fixed to the third and sixth pins 33, 40, respectively. The first and second nuts 41, 42 are respectively screwed near both ends of a screw rod 43 in which screws are uniformly formed in one direction extending from one end to the other end. In the middle of the screw rod 43, link driving means 26 is provided. The link driving means 26 is composed of a housing 47, a motor 48 accommodated in the housing 47, and reduction means 49, and one end 44a of an arm 44 is fixed in the housing 47, and the other end 44b is coupled to a mounting member 45 fixed nearly to the middle in the length direction of the base 3, so as to be dislocatable angularly by means of a seventh pin 46. The axial lines of the first to seventh pins 28, 31, 33, 35, 38, 40, 46 are all provided to be parallel to one surface of the base 3 and vertical to the forward direction A.

Length L1 between the first and third pins 28, 33 of the first link 27, length L2 between the second and third pins 31, 33 of the second link 30, length L3 between the fourth and sixth pins 35, 40 of the third link 34, and length L4 between the fifth and sixth pins 38, 40 of the fourth link 37 are all equal to each other. When the sole plate 2 and the base 3 are parallel to each other, length M1 between the center of the screw rod 43 and the third pin 33, and length M2 between the center of the screw rod 43 and the sixth pin 40 are also equal to each other.

Figure 5:
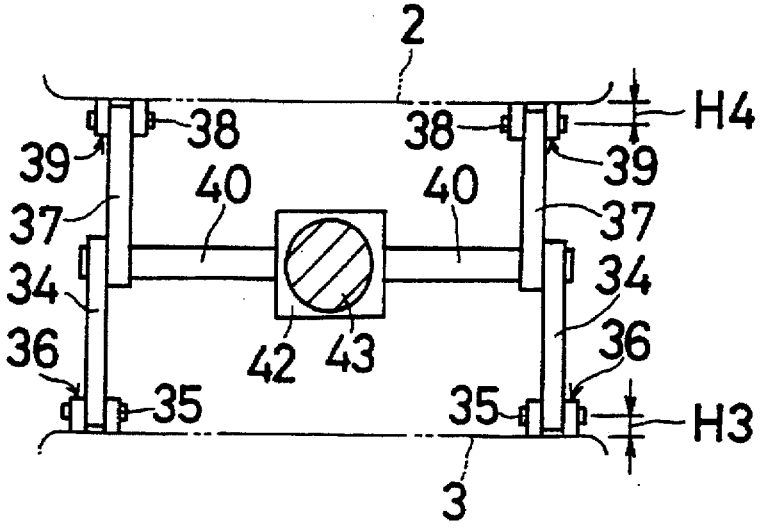
FIG. 5 is a simplified sectional view taken on cutting-plane line IV—IV in FIG. 4.

FIG. 5 is a simplified sectional view taken on cutting-plane line IV—IV of FIG. 4. In FIG. 5, the sole plate 2 and the base 3 are indicated by virtual lines. The sixth pin 40 is fixed to the second nut 42 so that the axial line of the sixth pin 40 and the axial line of the screw rod 43 may cross vertically, and therefore the screw rod 43 can be disposed so as to be dislocatable angularly within a virtual plane vertical to the axial line of the sixth pin 40.

Figure 6:
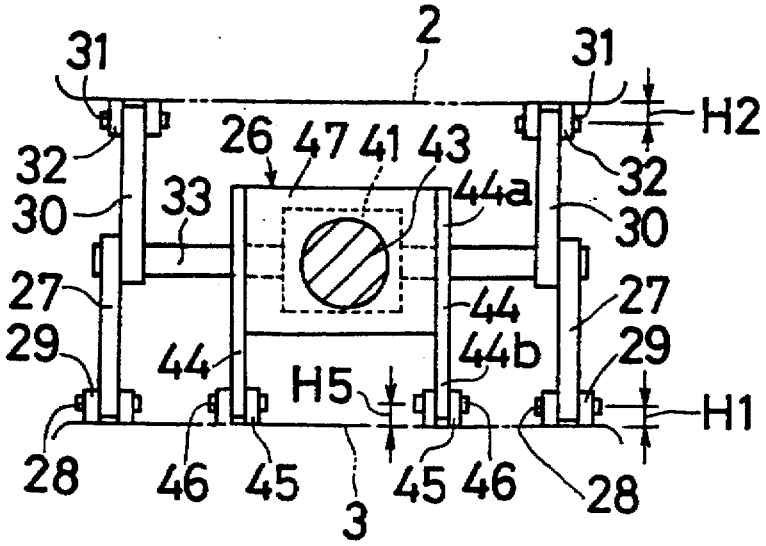
FIG. 6 is a simplified sectional view taken on cutting-plane line X—X in FIG. 4.

FIG. 6 is a simplified sectional view taken on cutting-plane line V—V of FIG. 3. The sole plate 2 and the base 3 are indicted by virtual lines. The first nut 41 is engaged with the screw rod 43, the third pin 33 is fixed in the first nut 41 so that the axial line of the third pin 33 and the axial line of the screw rod 43 may intersect vertically, and the first nut 41 is disposed so as to be dislocatable angularly around the axial line of the third pin 33. The screw rod 43 is inserted into a housing 47, and one end 44a of the arm 44 is inserted into the housing 47 of link drive means 26 so that the virtual plane including the longitudinal direction of the arm 44 may be vertical to the axial line of the screw rod 43. The screw rod 43 inserted into the housing 47 is rotated and driven around the axial line of the screw shaft 43 by a motor 48 such as direct-current motor through reduction means 49 realized, for example, by a planet gear.

Distance H1 between one surface on the link mechanism 25 side of the base 3 and the first pin 28, distance H2 between one surface on the link mechanism 25 side of the sole plate 2 and the second pin 31, distance H3 between one surface of the base 3 and the fourth pin 35, distance H4 between one surface of the sole plate 2 and the fifth pin 38, and distance H5 between one surface of the base 3 and the seventh pin 46 are all in equal length. Therefore, the first, fourth, and seventh pins 28, 35, 46 are provided on a plane parallel to the other side of the base 3, and the second and fifth pins 31, 38 are provided on a plane parallel to one side of the sole plate 2.

Figure 7:
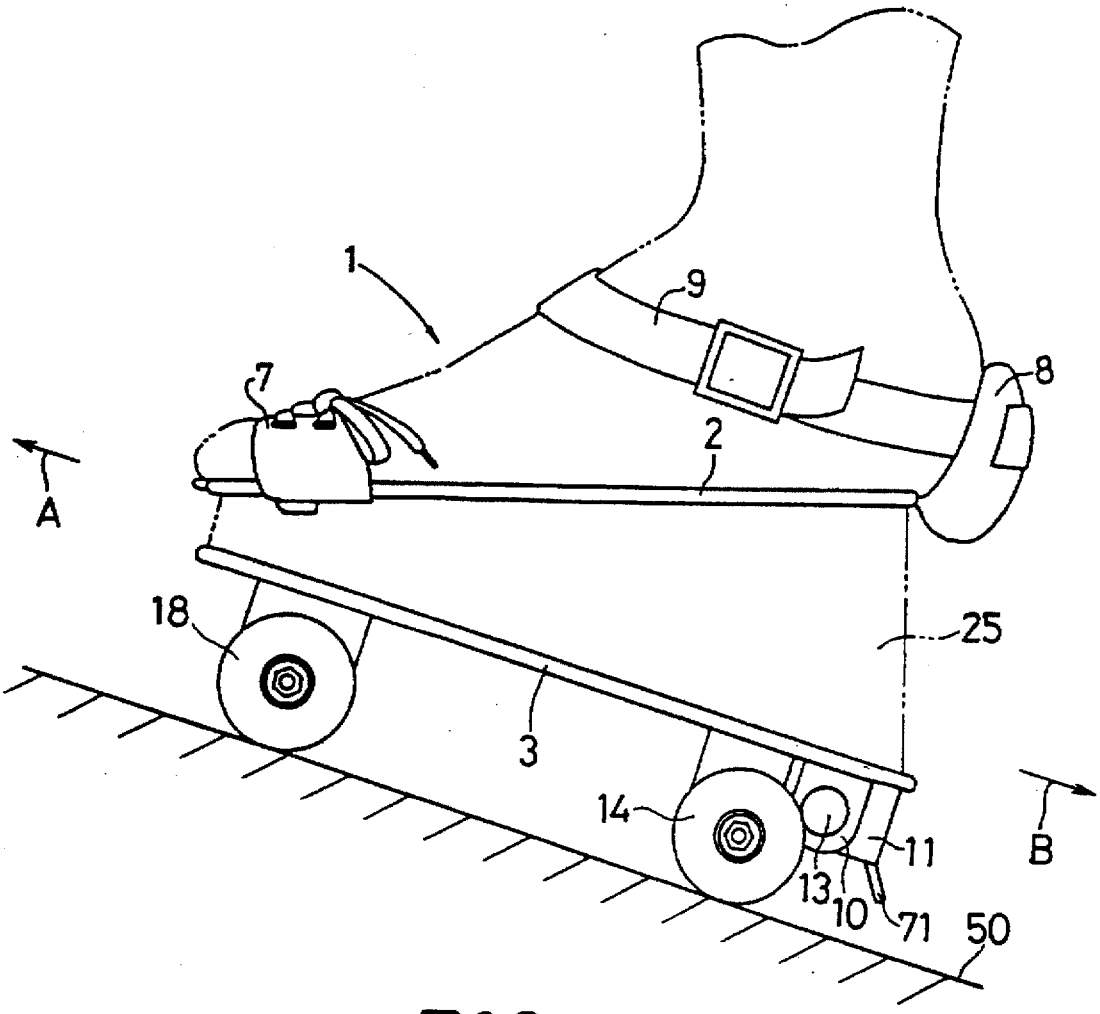
FIG. 7 is a simplified side view showing the state of use of the roller skate 1 on an upward slope.
Figure 8:
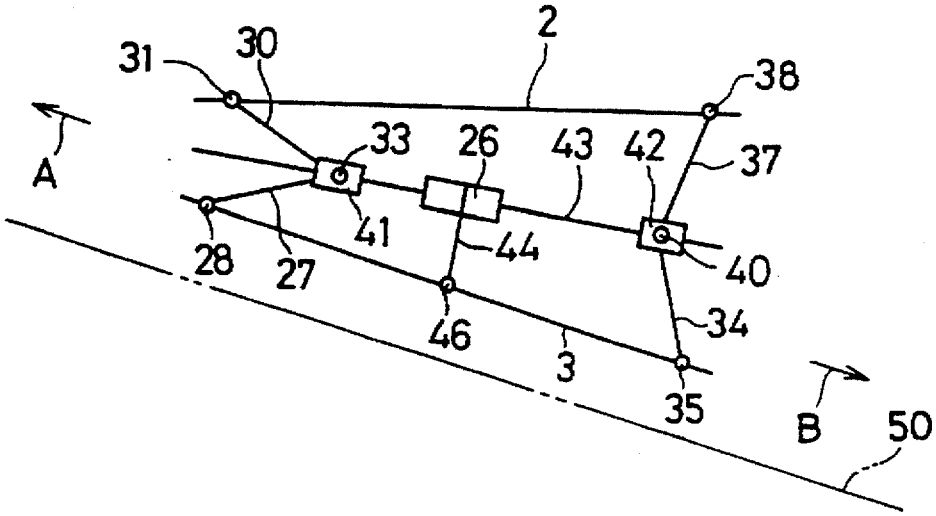
FIG. 8 is a skeleton diagram of a link mechanism 25 in FIG. 7.

FIG. 7 is a simplified side view showing the state of use when the roller skate 1 climbs up a slope 50, and FIG. 8 is a skeleton diagram of the link mechanism 25 in FIG. 7. When the slope 50 is climbed up by the roller skate 1, the link drive means 26 is driven, and the screw rod 43 is rotated normally so that the first and second nuts 41, 42 engaged with the screw rod 43 may move in the backward direction B. As the first nut 41 moves in the backward direction B, the first pin 28 and second pin 31 provided at the ends 27*a*, 30*a* of the first and second links 27, 30 are dislocated angularly in a mutually approaching direction. As the second nut 42 moves in the backward direction B, the third and fourth links 34, 37 are dislocated angularly so that the fourth pin 35 and fifth pin 38 provided at ends 34*a*, 37*a* of the third link 34 and fourth link 37 may depart from each other about the sixth pin 40. Therefore, the base 3 is tilted backward of the sole plate 2. Since the link drive means 26 is coupled with the base 3 through the arm 44 and seventh pin 46, when rotating and driving the screw rod 43, the link drive means 26 is prevented from rotating about the axial line of the screw rod 43. By tilting the base 3 until the sole plate 2 is nearly horizontal, the wearer of the roller skate 1 can climb up the slope 50 while keeping the feet in nearly horizontal state. By keeping the feet in nearly horizontal state, it is meant that the foot is kept horizontal from the heel to the toe, that is, the sole is nearly horizontal.

Figure 9:
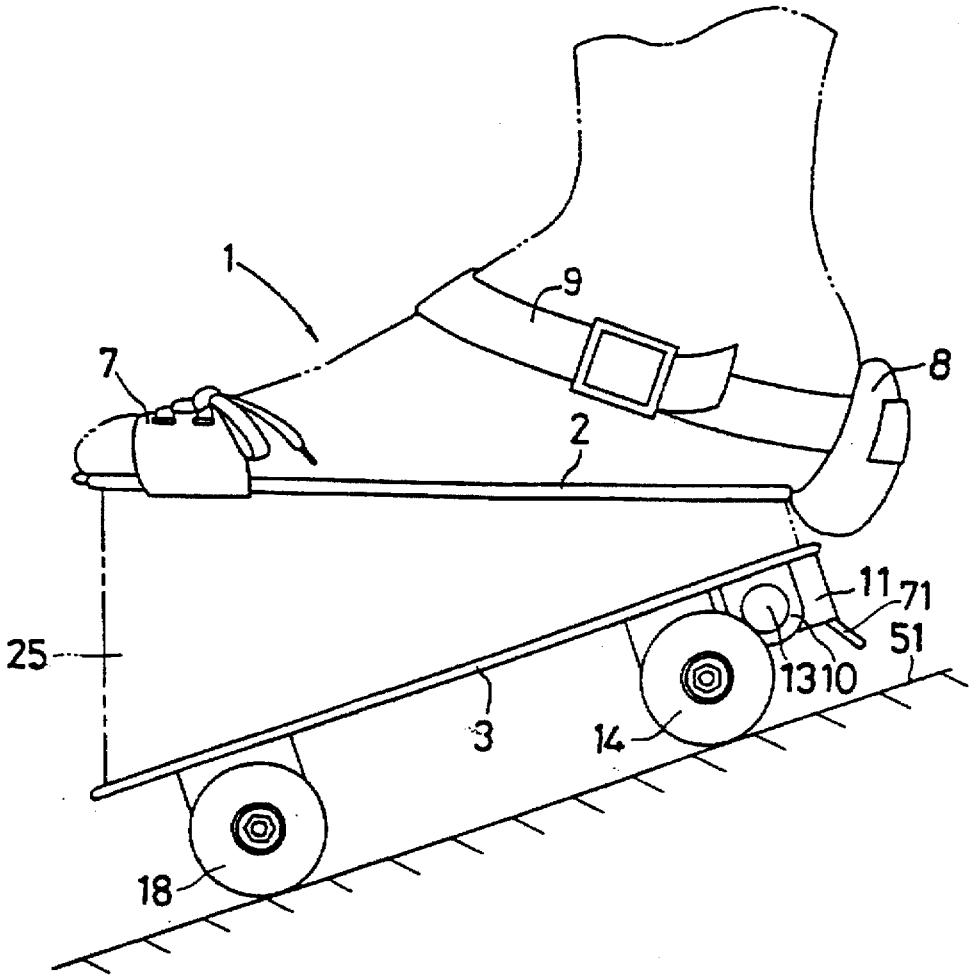
FIG. 9 is a simplified side view showing the state of use of the roller skate 1 on a downward slope.
Figure 10:
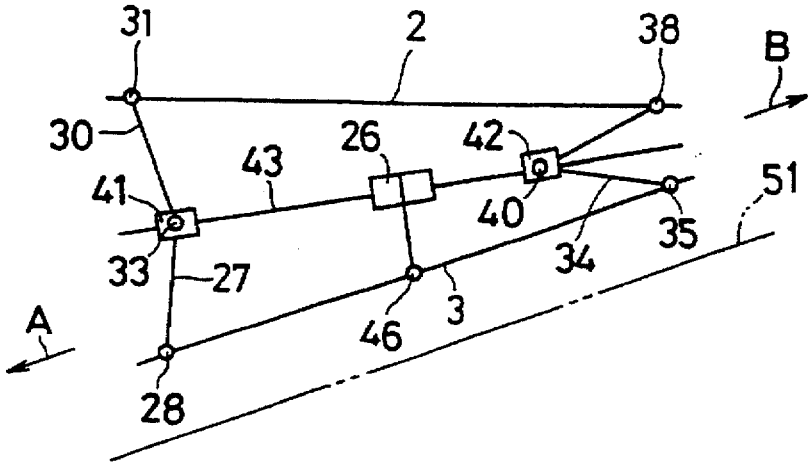
FIG. 10 is a skeleton diagram of a link mechanism 25 in FIG. 9.

FIG. 9 is a simplified side view showing the state of the roller skate 1 when going down a slope 51, and FIG. 10 is a skeleton diagram showing the link mechanism 25 in the state in FIG. 9. When descending the slope 51, the screw rod 43 is rotated reversely by the link drive means 26 so that the first and second nuts 41, 42 may move in the forward direction A. As the first nut 41 moves in the forward direction A, the first and second links 27, 30 are dislocated angularly in such a direction that the first and second pins 28, 31 may depart from each other about the third pin 33. As the second nut 42 moves in the forward direction A, the third and fourth links 34, 37 are dislocated angularly in such a direction that the fourth pin 35 and fifth pin 38 may approach to each other about the sixth pin 40. Therefore, the base 3 is tilted forward of the sole plate 2. By tilting the base 3 until the sole plate 2 is nearly horizontal, a person putting on the roller skate 1 can skate down the slope 51 while keeping the feet in nearly horizontal state.

Figure 11:
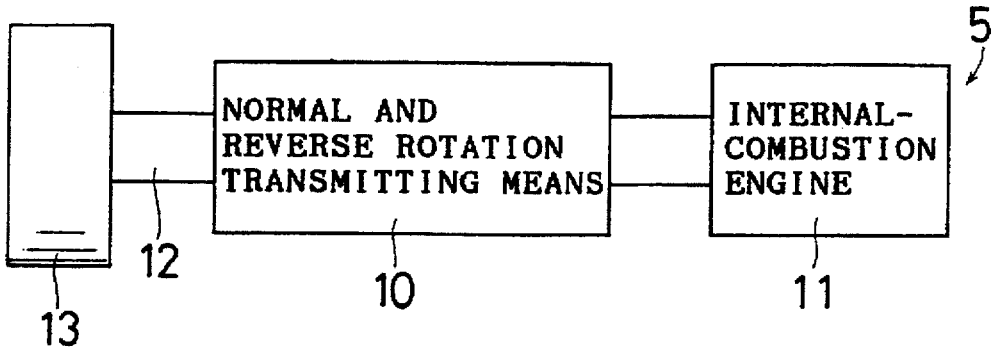
FIG. 11 is a structural diagram showing the constitution of running drive means.

FIG. 11 is a structural diagram showing a simplified constitution of running drive means 5. The running drive means 5 is composed of the internal-combustion engine the normal and reverse rotation transmitting means 10, the transmission wheel 13, and the transmission shaft 12. The rotation output of the internal-combustion engine 11 causes to rotate the transmission shaft 12 through the normal and reverse rotation transmitting means 10, and rotates and drives the transmission wheel 13 fixed on the transmission shaft 12. A driving wheel 14 is rotated and driven by the transmission wheel 13, and drives the roller skate 1. The normal and reverse rotation transmitting means 10 selectively changes over the rotation output of the internal-combustion engine 11 to the normal rotation state corresponding to the forward direction A of the roller skate 1, to the reverse rotation state in reverse rotating direction of normal rotation, and to the neutral state not transmitting the rotation output of the internal-combustion engine 11 to the transmission shaft 12. When skating on a flat road surface and an upward slope 50, by rotating normally the transmission wheel 13 by the internal-combustion engine 11, skating by the roller skate 1 is carried out in the forward direction A. By rotating reversely the transmission wheel 13 by the normal and reverse rotation transmitting means 10, skating by the roller skate 1 can be carried out in the backward direction B, and while skating by the roller skate 1 is being carried out in the forward direction A, it is braked by rotating reversely the transmission wheel 13. When skating down on the slope 51, by using the engine brake of the internal-combustion engine 11 realized, for example, by gasoline engine, the slope 51 descending speed can be controlled.

By changing over the normal and reverse rotation transmitting means 10 to the neutral state, the skater can skate by the skater's own kicking force.

Figure 12:
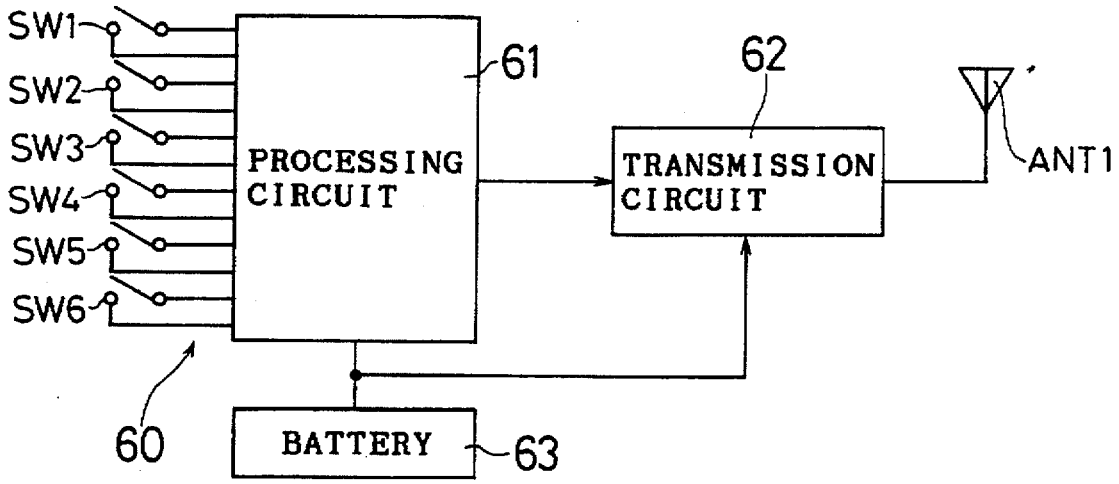
FIG. 12 is a block diagram showing a schematic electric constitution of holding means.

FIG. 12 is a block diagram showing a schematic electric constitution of holding means 60 for manipulating the link drive means 26 and running drive means 5. A processing circuit 61 realized by a microcomputer and others comprises an up-slope manipulation switch SW1, a stop manipulation switch SW2, a down-slope manipulation switch SW3, a forward manipulation switch SW4, a backward and brake manipulation switch SW5, and a neutral manipulation switch SW6 at the input side, and a transmission circuit 62 at the output side. A transmission signal sent from the transmission circuit 62 is transmitted as an electromagnetic wave or radio wave from a transmission antenna ANT1. The processing circuit 61 and transmission circuit 62 are driven by a drive voltage sent from a battery 63.

Figure 13:
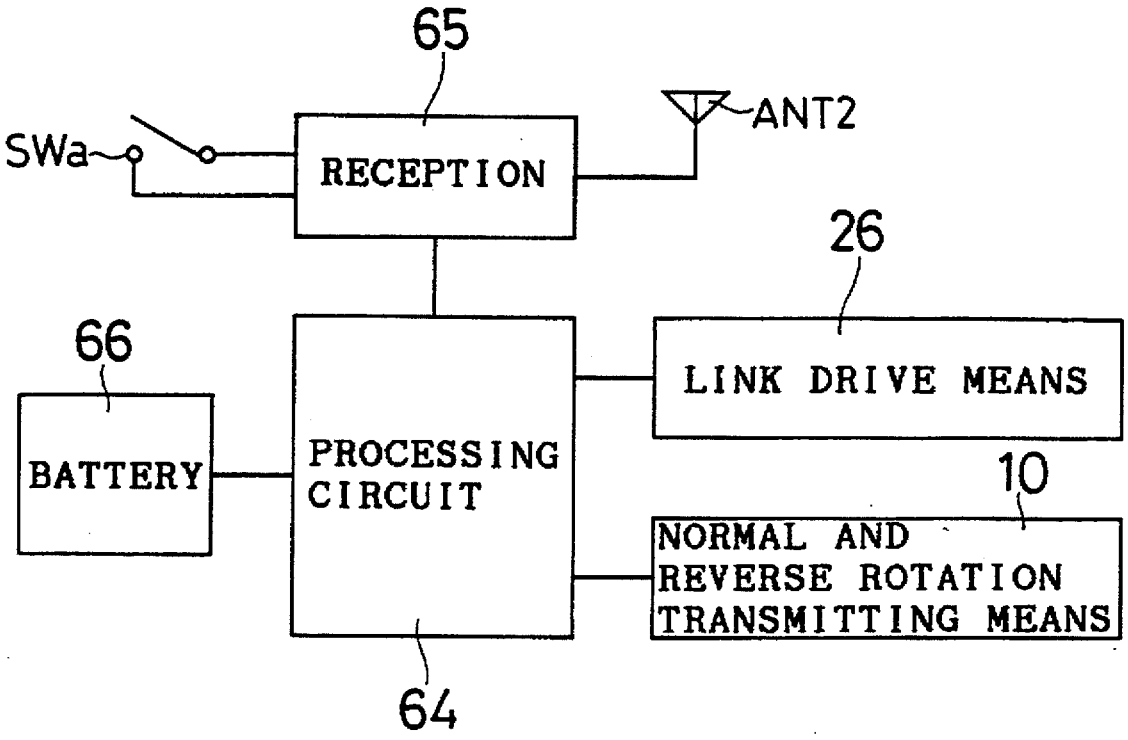
FIG. 13 is a block diagram showing a schematic electric constitution of the roller skate 1.

FIG. 13 is a block diagram showing a schematic electric constitution of the roller skate 1. At the input side of a reception circuit 65, a reception antenna ANT2 is provided, and at the output side, a processing circuit 64 realized by a microcomputer and others is disposed. At the output side of the processing circuit 64, the link drive means 26 and normal and reverse rotation transmitting means 10 are provided, and the processing circuit 64 is driven by a drive voltage sent from the battery 66.

When the up-slope manipulation switch SW1 shown in FIG. 12 is turned on, the input signal is transmitted as an electromagnetic wave from the transmission antenna ANT1, and is received by the reception antenna ANT2. When the input signal of the up-slope manipulation switch SW1 is received by the reception antenna ANT2, it is put into the processing circuit 61 as input signal, and in response to the signal in the processing circuit 61, the link drive means 26 is driven to rotate the screw rod 43 normally, and the base 3 is tilted forward of the sole plate 2. When the stop manipulation switch SW2 is turned on, the input signal is put into the processing circuit 64 in the same route as the up-slope manipulation switch SW1. At this time, the link drive means 26 stops the rotation of the motor 48, in response to the signal in the processing circuit 64, thereby stopping the tilting motion. When the backward manipulation switch SW3 is turned on, the input signal is put into the processing circuit 64 in the same route. At this time, the link drive means 26 rotates the screw rod 43 reversely, and the base 3 is tilted backward of the sole plate 2. When the forward manipulation switch SW4 is turned on, the input signal is put into the processing circuit 64 in the same route. At this time, in response to the signal in the processing circuit 64, the normal and reverse rotation transmitting means 10 rotates the transmission shaft 12 normally to move the roller skate 1 forward. When the backward and brake manipulation switch SW5 is turned on, the input signal is put into the processing circuit 64 in the same route. At this time, the normal and reverse rotation transmitting means 10 rotates the transmission shaft 12 reversely in response to the signal in the processing circuit 64, thereby moving the roller skate 1 backward or braking the roller skate 1 being moved forward.

When the brake manipulation switch SWa is turned on, the normal and reverse rotation transmitting means 10 rotates the transmission shaft 12 reversely, thereby braking the roller skate 1 being moved forward.

Figure 14:
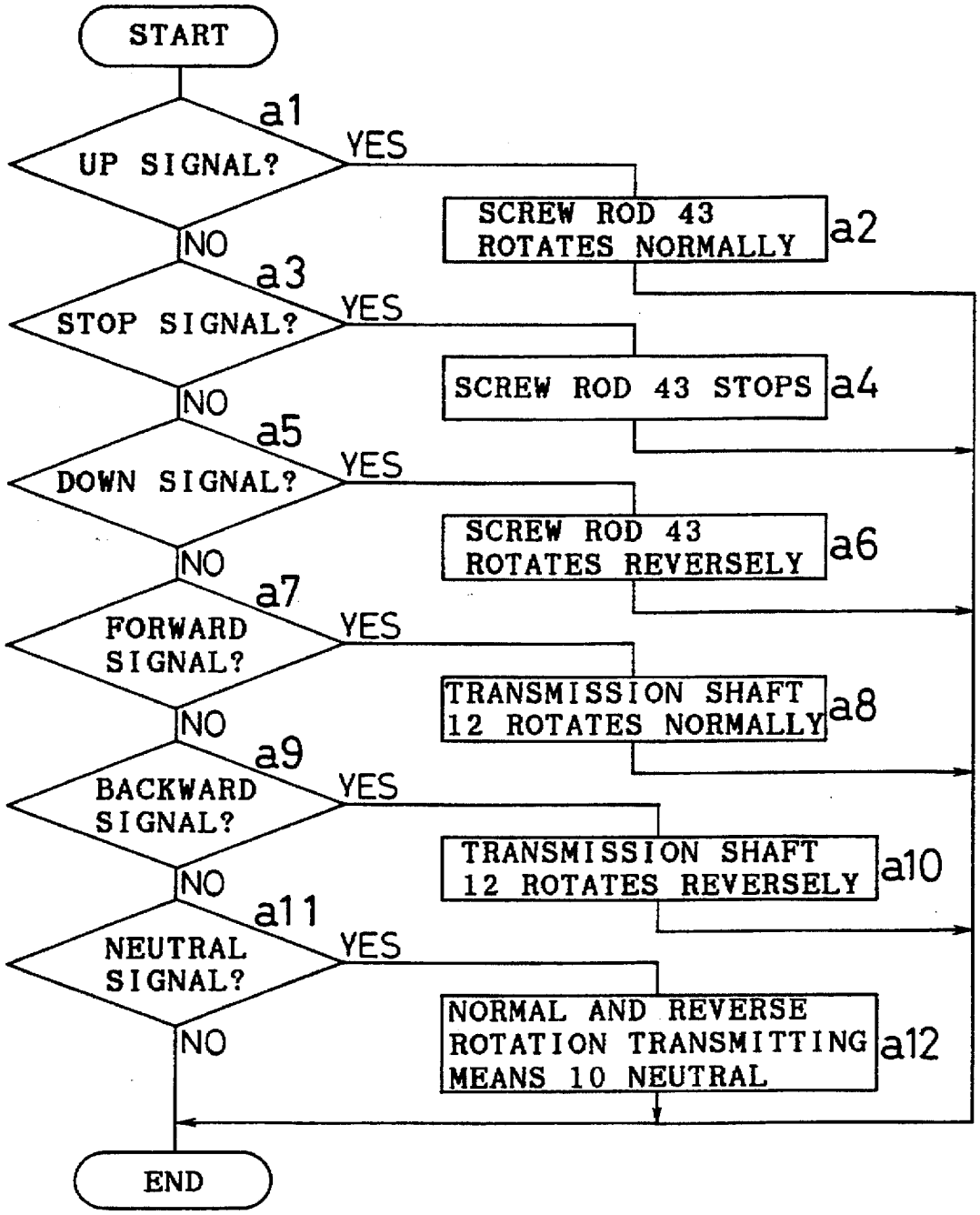
FIG. 14 is a flow chart showing the operating means of the roller skate 1.

FIG. 14 is a flow chart showing the operating means of the roller skate 1. At step a1, it is judged whether the up-slope manipulation switch SW1 provided at the input side of the processing circuit 61 is ON or OFF. In the case of ON, going to step a2, the screw rod 43 is rotated normally. In the case of OFF, go to step a3. At step a3, it is judged if the stop manipulation switch SW2 provided at the input side of the processing circuit 61 is ON or OFF. In the case of ON, going to step a4, the rotation of the screw shaft 43 is stopped. In the case of OFF, going to step a5, it is judged if the down-slope manipulation switch SW3 is ON or OFF. In the case of ON, going to step a6, the screw rod 43 is rotated reversely. In the case of OFF, going to step a7, it is judged if the forward manipulation switch SW4 is ON or OFF. In the case of ON, going to step a8, the transmission wheel 13 is rotated normally. In the case of OFF, going to step a9, it is judged if the backward manipulation switch SW5 is ON or OFF. In the case of ON, going to step a10, the transmission wheel 13 is rotated reversely. In the case of OFF, going to step a11, it is judged if the neutral manipulation switch SW6 is ON or OFF. In the case of ON, going to step a12, the normal and reverse rotation transmitting switch 10 is changed over to the neutral state.

Figure 15:
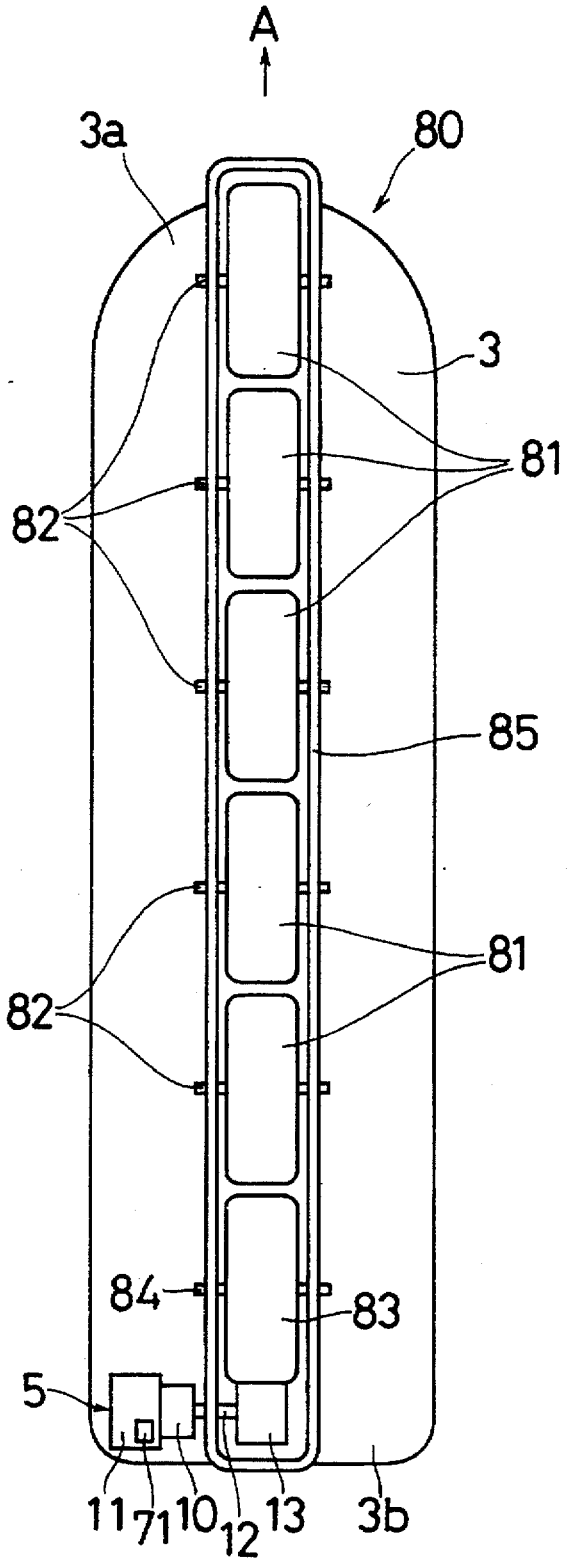
FIG. 15 is a bottom view of a roller skate 80 in other embodiment of the invention.

FIG. 15 is a simplified bottom view of one 80 of a pair of roller skates in other embodiment of the invention. The parts corresponding to the roller skate 1 are identified with same reference numerals. A roller skate 80 comprises plural driven wheels 81 and driving wheels 83 provided parallel to the running direction A, in the middle of the width direction vertical to the running direction A. Each one of the driven wheels 81 and driving wheels 83 has a rotary shaft 82 and 84 respectively, and each rotary shaft 82 and 84 is rotatably pivoted on a mounting element 85 provided on a base 3.

Running drive means 5 is provided in the driving wheel 83 provided at the end of the rear part **3*b* of the base 3. Therefore, the driving wheel 83 is rotated and driven by the running drive means 5. Besides, the driven wheels 81 and driving wheels 83** are arranged in a row in the running direction A, so that the skater can change the running direction smoothly.

The roller skate 80 may be also designed to mount the shoe detachably, or the shoe and the base 3 may be formed integrally. By thus integral composition of the shoe and base 3, the foot of the skater can be stably held in the roller skate.

Figure 16:
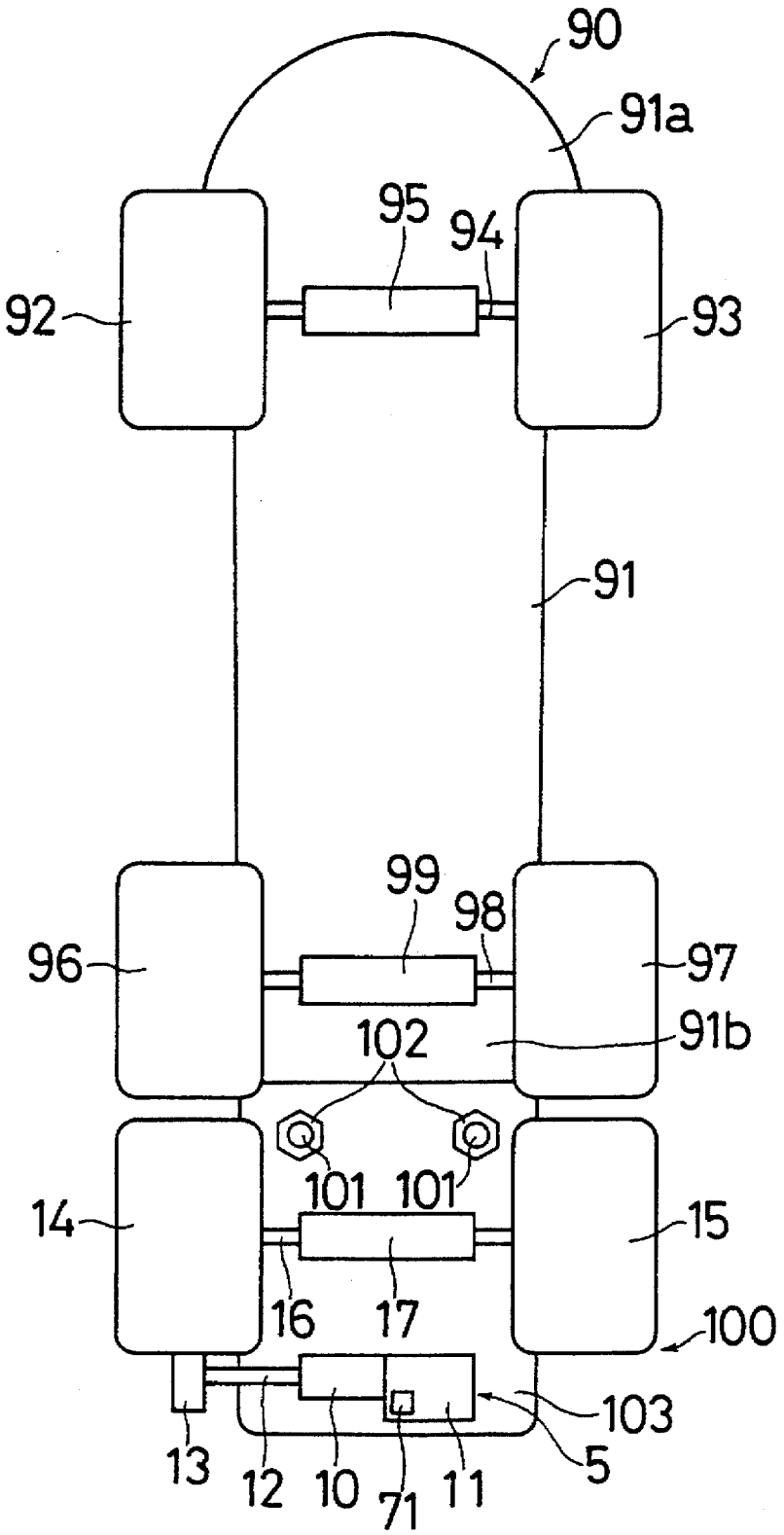
FIG. 16 is a bottom view showing the state of use of propulsive means 100 used in a roller skate in another embodiment of the invention.

FIG. 16 is a bottom view showing the state of use of propulsive means 100 used in a roller skate in a further different embodiment of the invention. The parts corresponding to the roller skate 1 of the roller skate in the embodiment of the invention are identified with same reference numerals. The propulsive means 100 comprises a rigid base plate 103, driving wheels 14, 15, and running drive means 5, and is detachably provided beneath the roller skate 90 of a roller skate, for example, at the left side of a commercial roller skate.

The skate 90 has a pair of wheels 92, 93 provided at the front part **91*a* of the base 91, and another pair of wheels 96, 97 are provided at the rear part 91*b* of the base 91. The wheels 92, 93 are coupled through a rotary shaft 94, and this rotary shaft 94 is rotatably mounted on the base 91 through a bearing 95. The wheels 96, 97 are similarly coupled through a rotary shaft 98, and the rotary shaft 98 is rotatably mounted on the base 91 through a bearing 99**.

The propulsive means 100 has driving wheels 14, 15 and running drive means 5 provided on a flat base plate 103. The driving wheels 14, 15 are mounted on a rotary shaft 16 by means of nuts or the like, and are rotatably mounted on the base 3 by a bearing 17. The driving wheel 14 is rotated and driven by the running drive means 5.

Such propulsive means 100 is detachably provided in the rear part **91*a* of the base 91 of the roller skate 90 by means of bolts 101 and nuts 102. When mounting the propulsive means 100, a pair of penetration holes are formed in the rear part 91*b* of the base 91, and it is fixed by the bolts 101 and nuts 102 through the insertion holes in the base 91 and insertion holes formed in the base plate 103. At this time, in order that the driving wheels 14, 15 may touch the road surface when the wheels 92, 93, 96, 97 of the roller skate 90 land on the road surface, the clearance of the base plate 103 and the base 91** is adjusted by, for example, inserting a thin plate in this clearance.

Since the propulsive means 100 is detachably attached to the roller skate, a roller skate with driving wheels may be easily realized by attaching the propulsive means 100 to a commercial roller skate.

By the operating means, moreover, control of forward, backward, and brake of the propulsive means 100 may be done by radio.

Incidentally, the tilting means 4 of the invention is not limited to the link mechanism. For example, the front parts **2*a*, 3*a* of the sole plate 2 and the base 3, respectively, may be coupled by pin so as to be dislocatable angularly, the rear parts 2*b*, 2*b* of the sole plate 2 and the base 3, respectively, may be formed so as to be opened and closed, and each rear part 2*b*, 3*b* may be fixed at desired positions relatively to each other by bolts and nuts or the like. In such constitution, using only when skating on a horizontal road surface or climbing up a hill, the height of the sole plate 2 may be set nearly at the same height as the base 3 when using a horizontal road surface. The tilting angle of the base 3 to the sole plate 2 may be adjusted in steps, for example, two to five steps, preferably three or four steps. Or, for example, when the internal-combustion engine 11 stops while climbing up a hill, to prevent from descending backward, a mechanism for preventing reverse rotation of the transmission shaft 12 when the internal-combustion engine 11 is stopped may be provided in the normal and reverse rotation transmitting means 10**.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A pair of roller skates, each comprising a base provided with plural wheels, a sole plate, a driving means to drive at least one of the plural wheels of one of the pair of roller skates, and a tilting means for tilting the base back and forth relative to the sole plate, provided between the base and the sole plate, wherein the tilting means includes a first link having one end coupled to the front part of the base by a first pin and extending backward, a second link having one end coupled to the front part of the sole plate by a second pin, the second link extending backward and having the other end coupled to the other end of the first link by a third pin, a third link having one end coupled to the rear part of the base by a fourth pin and extending forward, a fourth link having one end coupled to the rear part of the sole plate by a fifth pin, the fourth link extending forward and having the rear end coupled to the other end of the third link by a sixth pin, a first nut fixed to the third pin, a second nut fixed to the sixth pin, a screw rod having both ends which are screwed into the first and second nuts and extending along a longitudinal axis, and a motor rotating and driving the screw rod around the axial line of the screw rod.

2. The pair of roller skates of claim 1, wherein an operating means is provided for activating and inactivating the driving means by one hand.

3. The pair of roller skates of claim 1, wherein a brake means is provided at the posterior end of the base of one of the pair of roller skates.

4. The pair of roller skates of claim 2, wherein the driving means can be controlled by radio.

5. The pair of roller skates of claim 1, wherein the pair of roller skates can be attached so that shoes might be put on and off.

6. The pair of roller skates of claim 1, wherein plural wheels of each roller skate are arranged in line in the running direction.

7. A pair of roller skates of claim 1, wherein the driving means can be detached.

8. A pair of roller skates each comprising, a base provided with plural wheels, a sole plate on which a shoe can be detachably mounted, and a tilting means for tilting the base back and forth relative to the sole plate, provided between the base and the sole plate, wherein the tilting means includes a first link having one end coupled to the front part of the base by a first pin and extending backward, a second link having one end coupled to the front part of the sole plate by a second pin, the second link extending backward and having the other end coupled to the other end of the first link by a third pin, a third link having one end coupled to the rear part of the base by a fourth pin and extending forward, a fourth link having one end coupled to the rear part of the sole plate by a fifth pin, the fourth link extending forward and having the rear end coupled to the other end of the third link by a sixth pin, a first nut fixed to the third pin, a second nut fixed to the sixth pin, a screw rod having both ends which are screwed into the first and second nuts and extending along a longitudinal axis, and a motor rotating and driving the screw rod around the axial line of the screw rod.

* * * * *